US007219430B2

(12) United States Patent
Fandrey et al.

(10) Patent No.: US 7,219,430 B2
(45) Date of Patent: May 22, 2007

(54) OSCILLATING RAZORS

(75) Inventors: Ulrich Fandrey, Wetzlar (DE); Christopher Martin Hawes, Reading (GB); Evan Pennell, Hingham, MA (US); Uwe Schaaf, Alsbach-Hahnlein (DE); Florina Winter, Schmitten (DE)

(73) Assignee: The Gillette Company, Boston, MA (US)

( * ) Notice: Subject to any disclaimer, the term of this patent is extended or adjusted under 35 U.S.C. 154(b) by 77 days.

(21) Appl. No.: 11/076,203

(22) Filed: Mar. 8, 2005

(65) Prior Publication Data

US 2006/0200992 A1 Sep. 14, 2006

(51) Int. Cl.
*B26B 21/14* (2006.01)
*B26B 19/28* (2006.01)

(52) U.S. Cl. ..... 30/45; 30/527; 30/44

(58) Field of Classification Search ..... 30/34.2, 30/42, 44, 45, 527, 34.05
See application file for complete search history.

(56) References Cited

U.S. PATENT DOCUMENTS

| | | | | |
|---|---|---|---|---|
| 4,426,777 | A * | 1/1984 | Coleman et al. | 30/34.2 |
| 4,543,723 | A * | 10/1985 | Bortfeld et al. | 30/381 |
| 5,046,249 | A | 9/1991 | Kawara et al. | 30/45 |
| 5,113,585 | A | 5/1992 | Rogers et al. | 30/41 |
| 5,191,712 | A | 3/1993 | Crook et al. | 30/34.2 |
| 5,299,354 | A | 4/1994 | Metcalf et al. | 30/45 |
| 5,454,164 | A | 10/1995 | Yin et al. | 30/41 |
| 5,794,342 | A | 8/1998 | Davey | 30/45 |
| 6,029,354 | A | 2/2000 | Apprille, Jr. et al. | 30/47 |
| 6,481,104 | B1 | 11/2002 | Parker et al. | 30/45 |
| 6,742,643 | B2 * | 6/2004 | Nix et al. | 192/109 F |
| 2005/0172493 | A1 * | 8/2005 | Fischer et al. | 30/45 |

FOREIGN PATENT DOCUMENTS

WO WO 2004/073940 A1 9/2004

* cited by examiner

*Primary Examiner*—Hwei-Siu Payer
(74) *Attorney, Agent, or Firm*—Dara M. Kendall; Kevin C. Johnson

(57) ABSTRACT

A wet shave razor is provided that includes (a) a handle having a hollow head; (b) a cartridge having a body, the body having a surface for engaging the skin of the user and having at least one blade mounted therein; (c) an interconnect member, joined to the cartridge, constructed to pivotably and removably mount the cartridge to a distal end of the handle; and (d) an ejecting mechanism operatively connected to the handle to allow a user to disengage the interconnect member from the distal end of the handle, the ejecting mechanism including an actuator. The razor provides a vibrating function, and thus further includes a vibrating mechanism. A resilient element is positioned between the actuator and the handle, to damp vibration of the actuator in response to the vibration signal.

13 Claims, 6 Drawing Sheets

OSCILLATING RAZORS

TECHNICAL FIELD

This invention relates to oscillating razors, and more particularly to oscillating razors for wet shaving.

BACKGROUND

Vibrating shaver elements have been known for some time. Traditional electric razors, also known as dry shavers, are used without water, soap or shaving cream. Although such dry electric shavers provide a satisfactory shave many believe that the shave provided by an electric razor is not as close as a wet shave.

Wet shavers traditionally use soap and water or shave cream to soften the individual hairs of the beard of the user. The water and soap soften the individual hairs of the beard to make them much easier to cut.

There have been many attempts to provide an oscillating wet shaver, so as to combine the beard softening action of a wet shave with the oscillating cutting element of the traditional dry electric shaver. For example, U.S. Pat. No. 5,299,354 describes an oscillating wet shave razor that includes a miniaturized motor and a battery in a handle, the motor rotating an eccentric element within a head portion of the handle to provide oscillation at the blades of the razor. Other vibrating razors are described, for example, in U.S. Pat. Nos. 5,046,249, 5,794,342 and 6,481,104, and in WO 2004/073940. The complete disclosures of U.S. Pat. Nos. 5,046,249, 5,299,354, 5,794,342 and 6,481,104, and WO 2004/073940 are incorporated herein by reference.

Vibration at the surface of the razor blade cartridge is desirable because such vibration has a tendency to massage the skin and isolate the facial nerves from the discomforts of shaving. Moreover, the vibration imparted to the cartridge has the tendency to reduce the coefficient of friction between the cartridge and the face of the user to facilitate shaving comfort.

SUMMARY

In one aspect, the invention features a wet shave razor that includes (a) a handle having a hollow head; (b) a cartridge having a body, the body having a surface for engaging the skin of the user and having at least one blade mounted therein; (c) an interconnect member, joined to the cartridge, constructed to pivotably and removably mount the cartridge to a distal end of the handle; and (d) an ejecting mechanism operatively connected to the handle to allow a user to disengage the interconnect member from the distal end of the handle, the ejecting mechanism including an actuator. The razor provides a vibrating function, and thus further includes a vibrating mechanism.

The vibrating mechanism is constructed to impart vibration to the cartridge, and may include, for example, a motor, a shaft extending from the motor, and an eccentric element fixedly connected to the shaft and disposed for rotation within the hollow head. In this case, the motor is configured to be operatively connected to a power source and to rotate the eccentric element to provide a vibration signal, which is transmitted to the cartridge body to cause the cartridge body to vibrate. Other suitable vibrating mechanisms include electrical and mechanical mechanisms, and vibrating mechanisms that include piezoelectric crystals.

A resilient element is positioned between the actuator of the ejecting mechanism and the handle, to damp vibration of the actuator in response to the vibration produced by the vibrating mechanism. The inventors have found that, by providing this resilient element, undesirable noise resulting from the use of the vibrating function can be minimized. Thus, the razor provides a quiet, aesthetically pleasing shaving experience.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
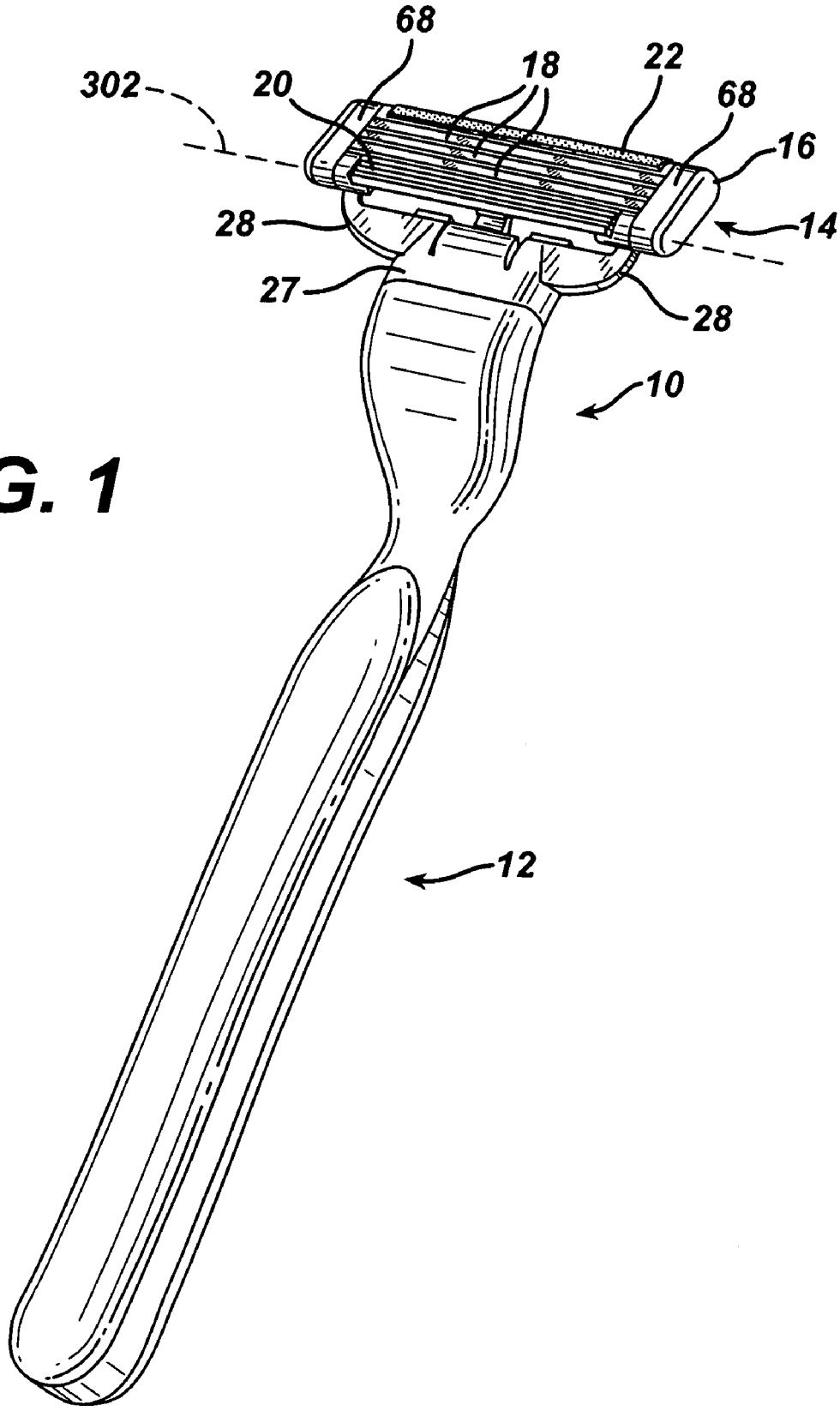
FIGS. 1 and 2 are, respectively, perspective views of a razor taken from the front and back.
Figure 2:
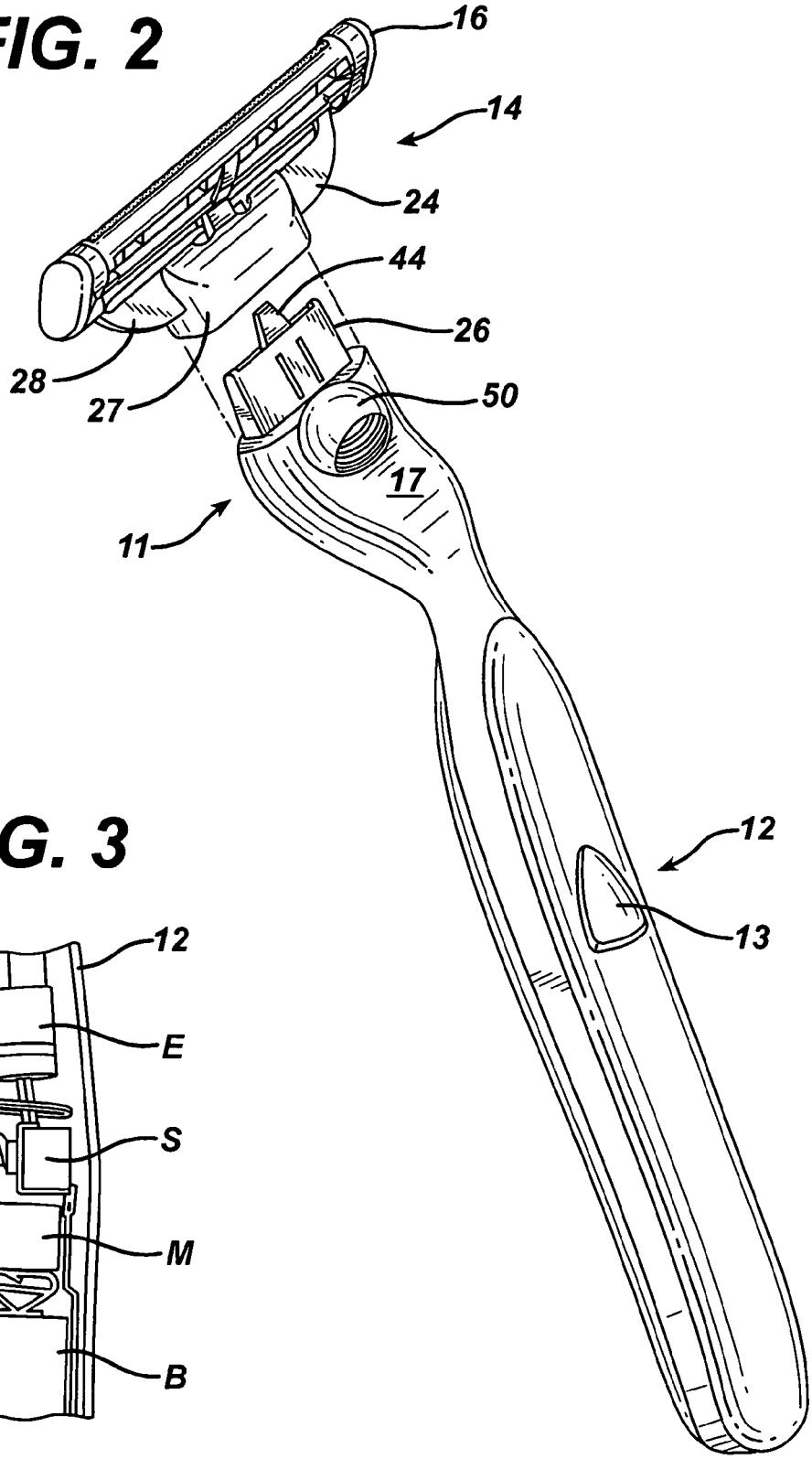

Referring to FIGS. 1 and 2, shaving razor 10 includes handle 12 and replaceable shaving cartridge 14. As shown in FIG. 2, cartridge 14 is removable from handle 12. Cartridge 14 includes housing 16, which carries blades 18, guard 20 and cap 22. Cap 22 provides a lubricous shaving aid and is received in a slot (not shown) at the rear of housing 16. Cap 22 may be made of a material comprising a mixture of a hydrophobic material and a water leachable hydrophilic polymer material, as is known in the art and is described, e.g., in U.S. Pat. Nos. 5,113,585 and 5,454,164, which are hereby incorporated by reference. Guard 20 includes a finned elastomeric unit mounted at the front of housing 16 to engage and stretch the user's skin; other skin engaging protrusions, e.g., as described in U.S. Pat. No. 5,191,712, which is hereby incorporated by reference, can be used.

Cartridge 14 also includes interconnect member 24 on which housing 16 is pivotally mounted about pivot axis 302. Interconnect member 24 includes base 27, which removably and fixedly attaches to asymmetrical extension 26 on handle 12, and two arms 28 that pivotally support housing 16 at its two sides.

Clips 68 are secured at the sides of housing 16 to retain blades 18 within housing 16 and to locate the cutting edges of the spring-biased blades at a desired exposure. As shown in FIG. 2, clips 68 also wrap around the bottom of housing 16 and prevent the removal of pivotal support ends of arms 28 of interconnect member 24. Base structure 27 of interconnect member 24 has an opening (not shown) at the top through which spring-biased plunger 44 of the handle passes to act on a cam surface (not shown) on the bottom of housing 16.

Razors having the structure described above and shown in FIGS. 1 and 2 are described in detail in U.S. Pat. No. 6,029,354, the complete disclosure of which is incorporated herein by reference.

Figure 3:
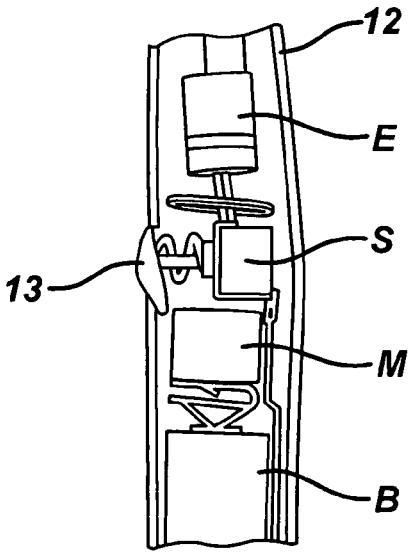
FIG. 3 is a partial cut-away side view of a portion of the razor of FIG. 1, showing the oscillating mechanism of the razor.

Razor 10 provides a vibrating function. As discussed above, reciprocating, vibrating, or oscillating motion razors, referred to collectively herein as "vibrating razors," are described, for example, in U.S. Pat. Nos. 5,046,249, 5,299,354, 5,794,342 and 6,481,104. The vibrating mechanisms described in any of these patents may be used in the razor described herein, if desired. An example of a suitable vibrating mechanism is shown diagramatically in FIG. 3. As indicated in FIG. 3, the razor may include a rotary motor M powered by a battery B, and an eccentric element E for imparting oscillating motion. Motor M, e.g., an electric motor, is housed within the handle and has an output shaft (not shown) on which is mounted the eccentric element E, e.g., an eccentric weight. Energization of the motor results in high speed rotation of the eccentric weight and thereby vibration of the razor and the blade unit in particular. The eccentric weight may be rotated at a speed of, for example, from about 5,000 rpm to about 10,000 rpm, causing the cartridge body to vibrate with an amplitude of about 0.002 inches to about 0.01 inches. The motor may be energized by a user by deflecting actuator 13 and thereby actuating a switch mechanism S.

Figure 4:
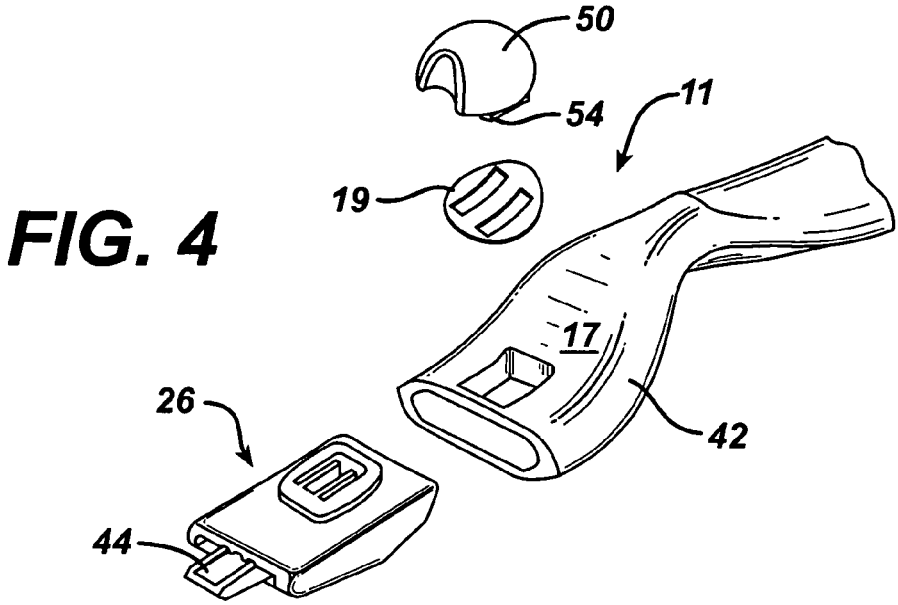
FIG. 4 is a partially exploded perspective view of a front portion of the handle of the razor of FIG. 1.
Figure 4A:
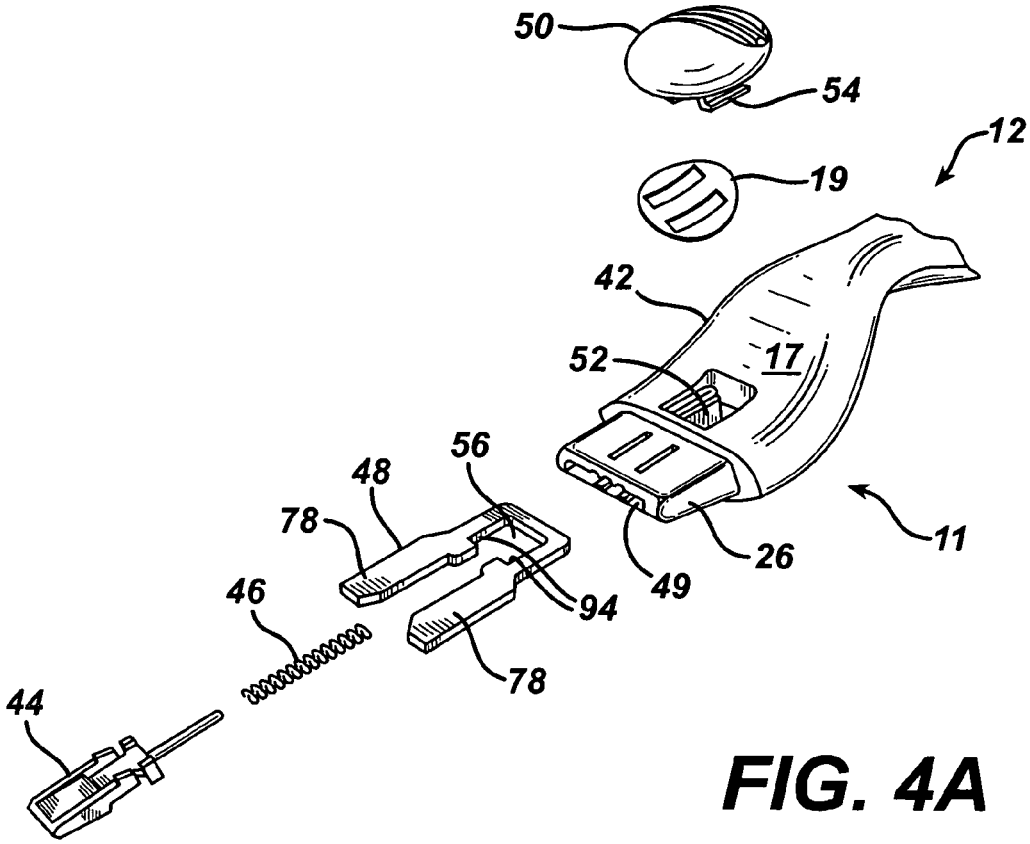
FIG. 4A is further exploded view of the same portion of the handle.

Referring to FIGS. 4 and 4A, handle 12 includes a cartridge support structure 42 that extends from the distal end 11 of the handle. Support structure 42 includes a trapezoidal extension 26, and houses the plunger 44 and spring 46 that provide biasing of housing 16 relative to interconnect member 24. Cartridge support structure 42 also houses a U-shaped ejector and carries a button 50 that together provide for ejection of cartridge 14 from handle 12.

U-shaped ejector 48 is received within recess 49 of cartridge support structure 42. Ejector button 50 is received in opening 52 on the top surface of support structure 42 and has bottom extensions 54 that are received within rectangular region 56 at the back narrow portion of ejector 48. Rectangular region 56 at narrow portion 82 of ejector 48 is normally aligned with opening 52 at the upper surface of support structure 42 when the button 50 is in its rest position. Rectangular region 56 is movable with respect to opening 52, along the long axis of handle 12, as ejector 48 is pushed forward by ejector button 50, out of recess 49 and into the base 27 of the interconnect member 24. Thus, pushing ejector button 50 forward in this manner causes the legs 78 of U-shaped ejector 48 to push against an inner surface of the interconnect member 24, ejecting the cartridge 14 from handle 12.

Figure 6:
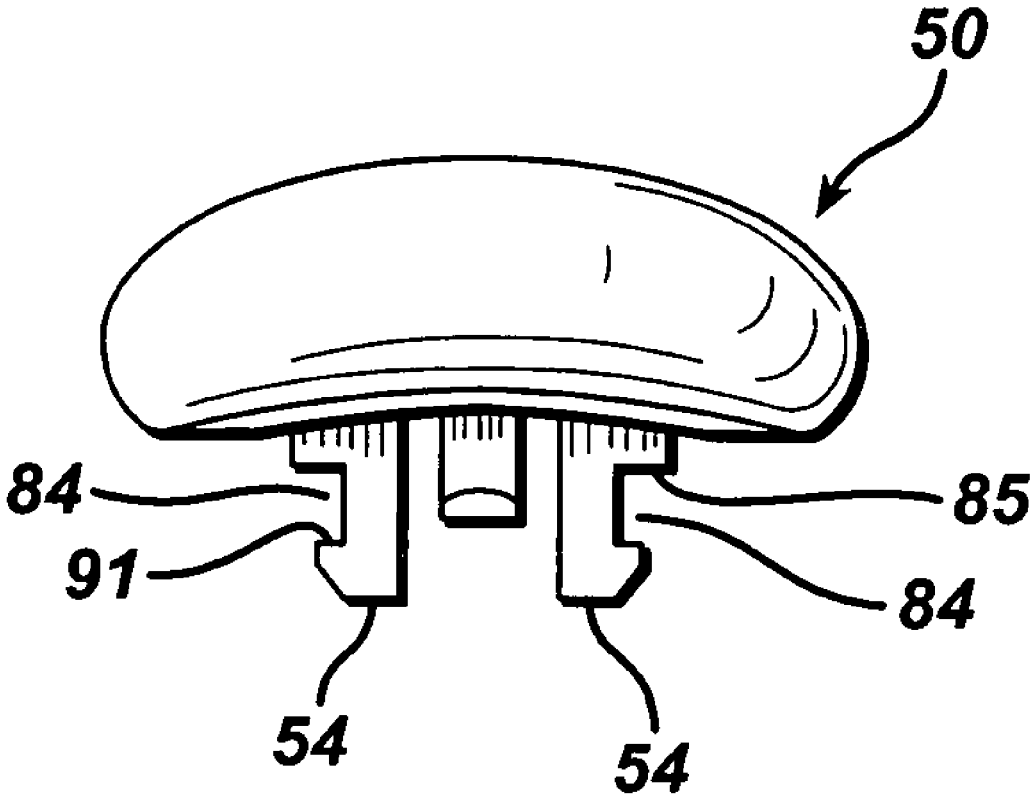
FIG. 6 is an enlarged end view of the button shown in FIGS. 4 and 4A.

Referring to FIG. 6, button 50 includes a pair of downwardly extending extensions 54. Each extension 54 of ejector button 50 has an outwardly directed groove 84 that slides on a respective track (not shown) within opening 52 of support structure 42. The upper surfaces 85 defining grooves 84 slide on upper surfaces of the tracks, and the lower surfaces 91 defining groves 84 effect capture on or abut lower surfaces of the tracks. Extensions 54, and the manner in which they cooperate with support structure 42 are described in further detail in U.S. Pat. No. 6,029,354, incorporated by reference above. Extensions 54 push against surfaces 94 of ejector 48 when ejector button 50 is pushed toward the distal end 11 of handle 12, causing the ejector 48 to move forward as discussed above. Spring 46 (FIG. 4A) extends through the space between extensions 54.

Figure 5:
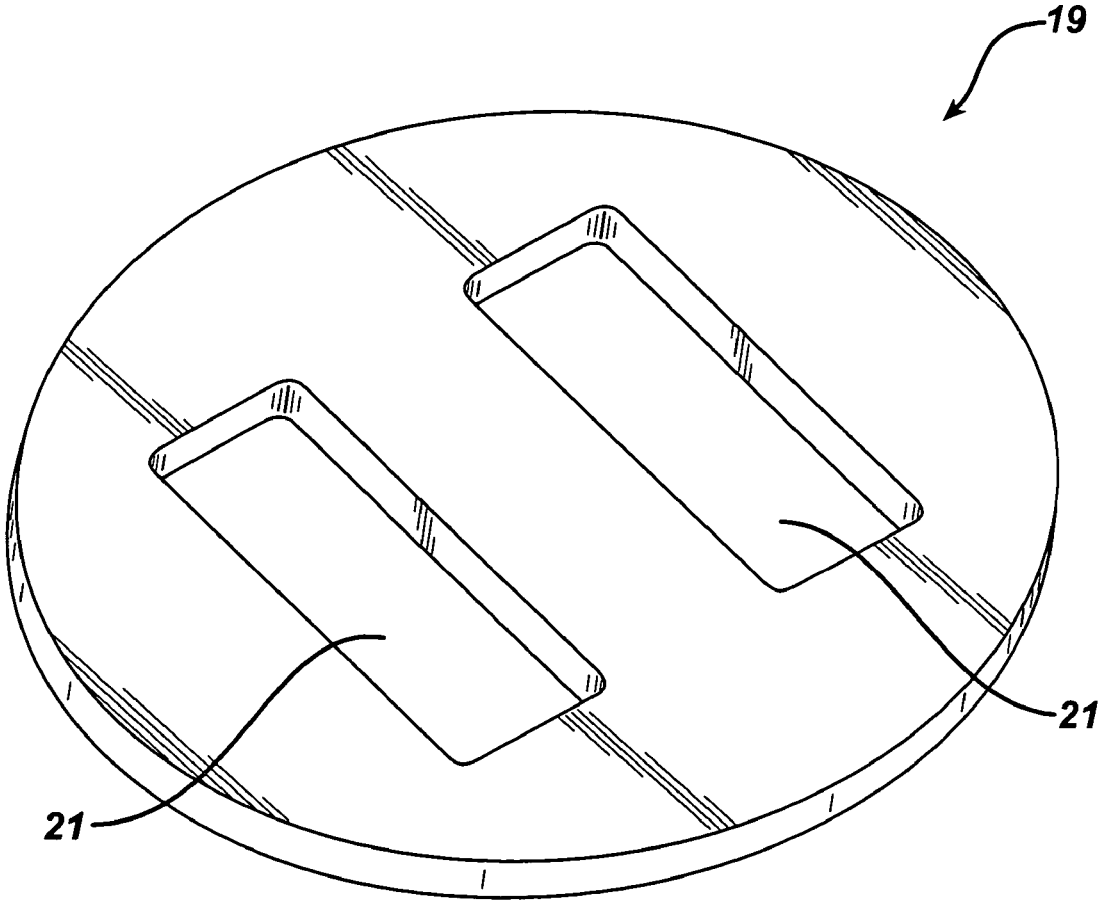
FIGS. 5 and 5A are, respectively, an enlarged perspective view and an enlarged top plan view of a resilient washer shown in FIGS. 4 and 4A.
Figure 5A:
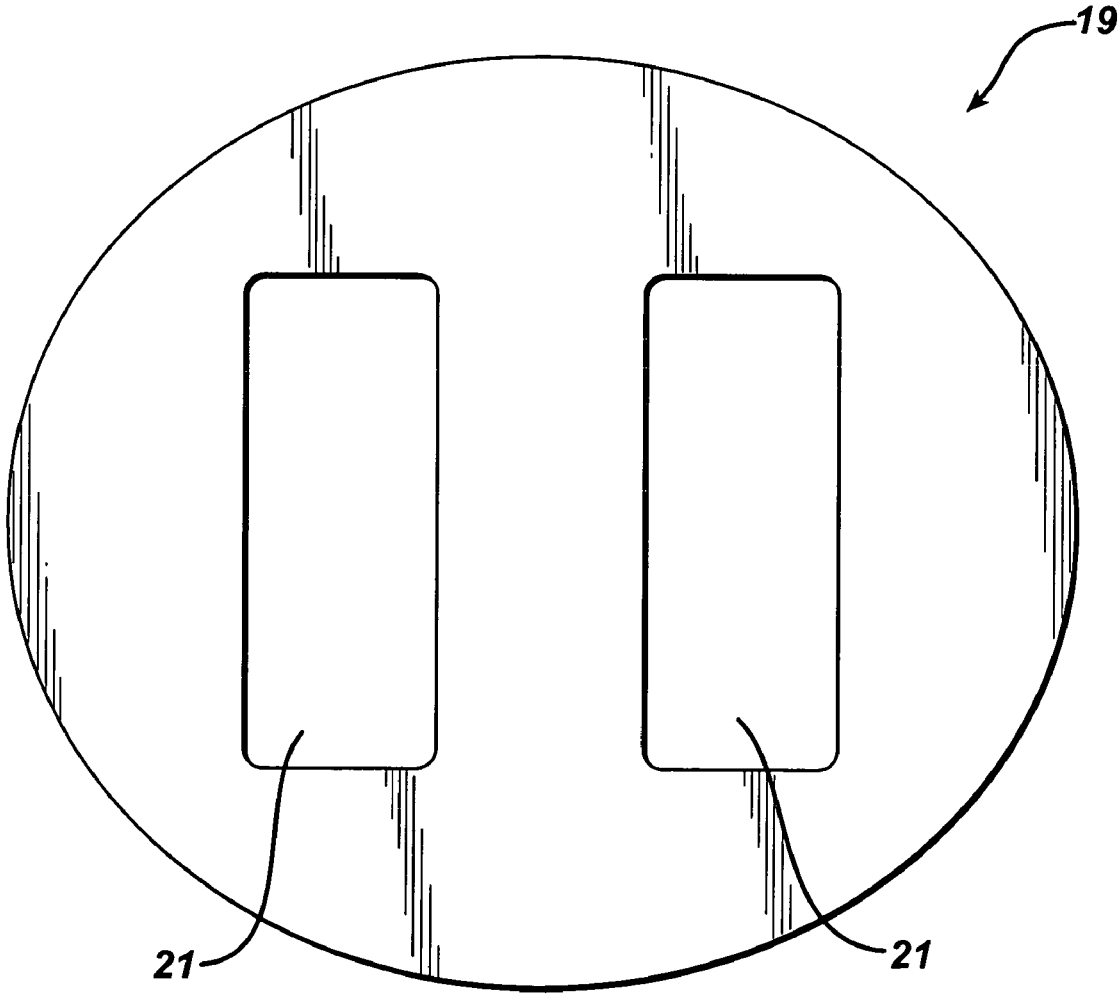

The button 50 can tend to rattle against the upper surface 17 of handle 12 when the vibrating function is activated. To prevent this from occurring, a resilient washer 19 is provided between the lower surface of button 50 and surface 17. As shown in detail in FIGS. 5 and 5A, resilient washer 19 includes a pair of elongated openings 21. Openings 21 are shaped to receive extensions 54 of button 50, and to allow the extensions to slide along the tracks in support structure 42 as discussed above. Generally, openings 21 are rectangular, as shown. The washer may be substantially ovoid, as shown in FIGS. 5 and 5A, or generally egg-shaped (oval at one end, tapering to an arcuate portion having a greater radius of curvature at the other end). If an egg-shaped washer is used, the narrower end is generally positioned closer to the cartridge 16. This shape tends to prevent the washer from wrinkling or buckling under the button as the button slides back and forth.

Resilient washer 19 may be formed of any desired material that will damp noise and vibration, while allowing the button to slide along the tracks without excessive friction. Suitable materials should also resist tearing as the button is moved back and forth over the life of the razor. Suitable materials include elastomers, and low friction polymers such as polytetrafluoroethylene. In some implementations, the resilient washer 19 includes a top layer, adjacent the lower surface of button 50, formed of an elastomer, e.g., SEBS, and a bottom layer, adjacent surface 17 of handle 12, formed of a low friction material, preferably polytetrafluoroethylene. In this case, the elastomer provides cushioning and vibration damping, while the polytetrafluoroethylene provides a low friction sliding surface. Preferred elastomers are sufficiently soft so as to damp vibration, yet sufficiently hard so as to be non-tacky. Some preferred elastomers have a hardness of from about 30 to 70 Shore A. It is generally preferred that the top layer be thicker than the bottom layer, the relative thicknesses being selected to provide the desired balance of vibration dampening and durability of the low friction surface. The two layers may be provided using any suitable manufacturing process, e.g., comolding or coextrusion. It is not necessary that the two layers be adhered or laminated to each other; if desired the two layers may be assembled into the razor simply by laying one layer on top of the other. Alternatively, the resilient washer may be formed entirely of a single polymer that provides both properties, e.g., a resilient grade of polytetrafluoroethylene. It is generally preferred that the washer 19 be as thin as possible, while still providing good vibration/noise damping and durability of the washer.

A number of embodiments of the invention have been described. Nevertheless, it will be understood that various modifications may be made without departing from the spirit and scope of the invention.

For example, in addition to the shapes discussed above, the washer may have any other desired shape. It is generally preferred that the washer be shaped to conform to the shape of the button, so that it is not visible to the user.

It is not necessary that the resilient element be a discrete component. In some cases, the resilient element may be integral with the button. For example, the button may include an upper layer, e.g., of rigid plastic, defining the shape of the button, and a lower layer, adjacent the surface 17 of handle 12, of a resilient, low friction material such as the materials discussed above. The lower layer may be disposed directly beneath the upper layer, like the washers discussed above, or may be positioned in other manners, e.g., extending downwardly from the edge of the upper layer.

In other embodiments, the resilient element may be a portion of the ejecting mechanism. For example, extensions 54 of button 50 may be formed of a resilient material, e.g., an elastomer.

Accordingly, other embodiments are within the scope of the following claims.

What is claimed is:

1. A wet shave razor comprising:

a handle having a hollow head;

a cartridge having a body, the body having a surface for engaging the skin of a user and having at least one blade mounted therein;

an interconnect member, joined to the cartridge, constructed to pivotably and removably mount the cartridge to a distal end of the handle;

an ejecting mechanism operatively connected to the handle to allow the user to disengage the interconnect member from the distal end of the handle, the ejecting mechanism including an actuator wherein the ejecting mechanism includes a body defining a pair of tracks and an ejector disposed within the body and positioned to push against a surface of the interconnect member when the actuator is actuated, and the actuator comprises a button having extensions configured to slidingly engage the tracks and to cooperate with the ejector;

a vibrating mechanism configured to impart vibration to the cartridge; and a resilient element, positioned between the actuator and the handle, to damp vibration of the actuator in response to the vibration produced by the vibrating mechanism and wherein the resilient element includes a pair of openings configured to receive the extensions.

2. The razor of claim 1 wherein the resilient element comprises an elastomeric material.

3. The razor of claim 1 or 2 wherein the resilient element comprises polytetrafluoroethylene.

4. The razor of claim 1 wherein the openings are elongated to correspond generally in shape to the tracks.

5. The razor of claim 1 wherein the resilient element is generally ovoid.

6. The razor of claim 1 wherein the resilient element is integral with the button.

7. The razor of claim 6 wherein the button includes an upper layer defining the shape of the button, and a lower layer of a resilient material defining the resilient element.

8. The razor of claim 7 wherein the lower layer is disposed directly beneath the upper layer.

9. The razor of claim 7 wherein the lower layer extends downwardly from the edge of the upper layer.

10. The razor of claim 1 wherein the vibrating mechanism includes:

a motor, a shaft extending from the motor, and an eccentric element fixedly connected to the shaft and disposed for rotation within the hollow head, the motor being configured to be operatively connected to a power source and to rotate the eccentric element to provide a vibration signal, the vibration signal being transmitted to the cartridge body to cause the cartridge body to vibrate.

11. The razor of claim 1 wherein the resilient element is positioned between an inner surface of the actuator and an outer surface of the handle.

12. A wet shave razor comprising:

a handle having a hollow head;

a cartridge having a body, the body having a surface for engaging the skin of a user and having at least one blade mounted therein;

an interconnect member, joined to the cartridge, constructed to pivotably and removably mount the cariridge to a distal end of the handle;

an ejecting mechanism operatively connected to the handle to allow the user to disengage the interconnect member from the distal end of the handle, the ejecting mechanism including an actuator;

a vibrating mechanism configured to impart vibration to the cartridge; and a resilient element, positioned between an inner surface of the actuator and an outer surface of the handle, to damp vibration of the actuator in response to the vibration produced by the vibrating mechanism.

13. The razor of claim 12 wherein the resilient element is integral with the inner surface of the actuator.

* * * * *